US006409091B1

(12) United States Patent
Simpson

(10) Patent No.: US 6,409,091 B1
(45) Date of Patent: Jun. 25, 2002

(54) TOY RAILROAD TRACK FOR USE ON A BATHTUB

(76) Inventor: Richard E. Simpson, 32 Ellis Ct., Pleasant Hill, CA (US) 94523

( * ) Notice: Subject to any disclaimer, the term of this patent is extended or adjusted under 35 U.S.C. 154(b) by 0 days.

(21) Appl. No.: 09/496,678

(22) Filed: Feb. 2, 2000

Related U.S. Application Data

(63) Continuation-in-part of application No. 09/133,756, filed on Jan. 9, 1998, now abandoned.

(51) Int. Cl.[7] ..... E01B 23/00
(52) U.S. Cl. ..... 238/10 A
(58) Field of Search ..... 238/10 R, 10 A, 238/10 B, 10 C, 10 E, 10 F

(56) References Cited

U.S. PATENT DOCUMENTS 2,387,859 A * 10/1945 Schmidt ..... 238/10 A
3,424,379 A * 1/1969 Giammariano et al. ... 238/10 F
3,480,210 A * 11/1969 Perrinjaquet ..... 238/10 R
3,650,468 A * 3/1972 Ewe et al. ..... 238/10 E
5,000,715 A * 3/1991 Johnson ..... 238/10 B
5,085,148 A * 2/1992 Konno ..... 238/10 A

* cited by examiner

*Primary Examiner*—Mark T. Le

(57) ABSTRACT

For use with a toy train being formed by a toy engine and a plurality of cars, a toy railroad track includes a plurality of straight and curved track sections. Each track section has a top surface and a bottom surface. The straight and curved track sections are coupled together to form a toy railroad track. The toy railroad track also includes a plurality of straight and curved layers. Each layer has a plurality of suction cups and is coupled to the bottom surface of one of the straight and curved track sections so that the toy railroad track may be securely coupled to a peripheral surface of a bathtub. The toy train rides on the top surface of the toy railroad track.

5 Claims, 4 Drawing Sheets

17
15
21

21
15
18

15
21
17
18

4
4
15
21

TOY RAILROAD TRACK FOR USE ON A BATHTUB

This is a continuation-in-part of an application filed Jan. 9, 1998 under Ser. No. 09/133,756, now abandoned.

BACKGROUND OF THE INVENTION

The invention relates to a toy railroad track for use on a bathtub.

U.S. Pat. No. 3,438,145 teaches a toy railroad assembly which includes a figure-of-eight track section. The figure-of-eight track section is formed by a pair of symmetrically-arranged annular guide channels which communicate with each other through an isthmus. One bank of the isthmus is formed by a cusp-shaped, removable subsection whose converging guide walls are common to the annular guide channels such that when the subsection is withdrawn the annular guide channels are converted to a single flow-through channel acting to interconnect associated track sections which are coupled to the end ports in the figure-of-eight track section.

U.S. Pat. No. 3,579,904 teaches a versatile toy railroad assembly in which various track layouts may be formed by different arrangements of square boards. Each board has a depressed track section therein adapted to communicate with track sections on contiguous boards to define a track layout whose pattern is determined by the manner in which the boards are interrelated. The boards are also provided with peg holes adapted to receive the supporting pegs of diversified scenic elements, such that by straddling adjacent boards with scenic elements, the boards are interlocked thereby to maintain a predetermined layout.

U.S. Pat. No. 5,503,330 teaches model railroad track assemblies which are formed from preassembled track sections. Each preassembled track section includes a pair of spaced-apart parallel metal rails which are molded in place in a one-piece ladder-like body and a track accessory which is in the form of a one-piece molded plastic body having no undercuts to permit fabrication of the body by simple two-piece open and close molds. Male latching members and female engagement structures are integrally molded at each end of each track body, side-by-side for releasible latching engagement with like structures on the ends of like bodies. Each molded body including its latching members and engagement structures is adapted by the provision of suitable openings, spaces and recesses to permit top to bottom nesting engagement of identical track assemblies with one another for protection and reduced storage size.

U.S. Pat. No. 4,669,657 teaches a toy-train play setting which has a landscape base structure molded in one piece. An upper surface is formed thereon a track-way, a depressed roadway portion. There are upwardly extending wall portions of generally rectangular form for detachably receiving thereon a simulated building, which, when attached, form door like openings about a track-way section for passage there-through of the train. A building serves for storage of the train vehicles. A lower surface is provided with a channel portion, which in conjunction with the surface on which the play setting is positioned, forms a lower tunnel. A handle is provided for portability of the play setting.

U.S. Pat. No. 3,604,626 teaches a toy track which includes a base member to which a plurality of tie members are connected. A length of rail supported on these tie members is held in place by a plurality of rail clips spaced along the rail length so as to secure it to the base member in the spacing defined between adjacent pairs of tie members.

The arrangement is such that the rail length is maintained in positive compressive relationship against the tie members. Means are also provided whereby the spacing or gauging of the tie members can be positively set and maintained during construction of the tracks.

U.S. Pat. No. 5,480,140 teaches a basketball game which has a basketball hoop, a net and a sponge ball. The basketball hoop is circular and has a lower surface and an upper surface. The lower surface has a plurality of securement eyes thereon. The net has a plurality of U-shaped securement strings each of which is attached to one of the plurality of securement eyes of the lower surface of the basketball hoop. The basketball game is played in a bathtub. The basketball hoop has suction cups which couple it to a wall of the bathtub. The sponge ball serves as a ball to shoot through the basketball hoop.

Bathtubs and shower stalls are well known to be quite slippery when wetted and stood or sat upon during showers and baths. One conventional remedy is to adhere strips of adhesive material having abrasive or skid resistant upper surfaces permanently to the bottom of these bathtubs and shower stalls.

Another well known remedy for this problem is to utilize rubber or latex bath mats which include an array of suction cups disposed downwardly from the bottom surface which releasably adhere atop the bottoms of bathtubs and shower stalls.

U.S. Pat. No. 5,050,591 teaches a water massage mat which includes a substantially rectangular cover formed of two leaves of suitable flexible material welded together along weld lines so as to form a structure similar to a small air mattress. The weld lines include a perimetrical weld line extending along the perimeter of the cover and a second internal weld line configured so as to define a first hermetically sealed channel and a second channel closed at one of its ends and connected at its other end to a feeder pipe which is adapted to be connected to a source of compressed air. These internal weld lines, as viewed from above are serpentine shaped. Small holes are formed in the upper surface of the second channel and are capable of allowing the compressed air from the feeder pipe to flow out of the second channel so as to generate a water massage effect. A plurality of suction cups fasten the cover to the bottom of a tub or basin. The first and second channels are formed such that, when inflated, the first channel is larger in diameter than the second channel, and the upper surface of the second channel is vertically lower than the upper surface of the first channel. With this arrangement, the user's body can be supported by the first channel with a gap formed above the small holes of the second channel to allow air to flow there-through.

U.S. Pat. No. 5,069,951 teaches a magnetized bath mat removably connectable atop the magnetically attractive bottom of a bathtub or shower stall which includes a thin, flexible magnetic base sheet permanently adhered to and beneath a thin, flexible non-magnetic upper sheet. The base sheet is permanently magnetized so that its bottom surface is releasably attractable to the tub or shower bottom to provide a high degree of slip resistance between the bath mat and the tub or shower bottom during normal use. The upper sheet is coextensive with the base sheet and has a top surface which is generally slip resistant to a user standing or sitting thereatop under wet conditions of use.

The inventor incorporates the teachings of the above-cited patents into this specification.

SUMMARY OF INVENTION

The present invention is generally directed to a toy railroad assembly which includes a toy engine, a plurality of cars, a plurality of straight track sections and a plurality of curved track sections. Each track section has a top surface and a bottom surface. The straight and curved track sections may be coupled together to form a toy railroad track. The toy engine is coupled to the plurality of cars in order to form a toy train. The toy train rides on the top surface of the toy railroad track.

In a first, separate aspect of the present invention, each track section has a layer with a plurality of suction cups. The suction cups are coupled to the bottom surface of the track sections so that the toy railroad track may be securely coupled to a peripheral surface of a bathtub.

In a second, separate aspect of the present invention, the peripheral surface of a bathtub has a layer of magnetic material which is adhered thereto and each track section has a plurality of magnets. The magnets are coupled to the bottom surface of the track sections so that the toy railroad track may be securely coupled to a peripheral surface of a bathtub.

In a third, separate aspect of the present invention, the peripheral surface of a bathtub has a layer with a plurality of female fasteners which is adhered thereto and each track section has a plurality of male fasteners. The male fasteners are coupled to the bottom surface of the track sections so that the toy railroad track may be securely coupled to a peripheral surface of a bathtub.

In a fourth, separate aspect of the present invention, each track section is made out of a plastic material.

In a fifth, separate aspect of the present invention, each track section is made out of rubber.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENTS

Figure 1:
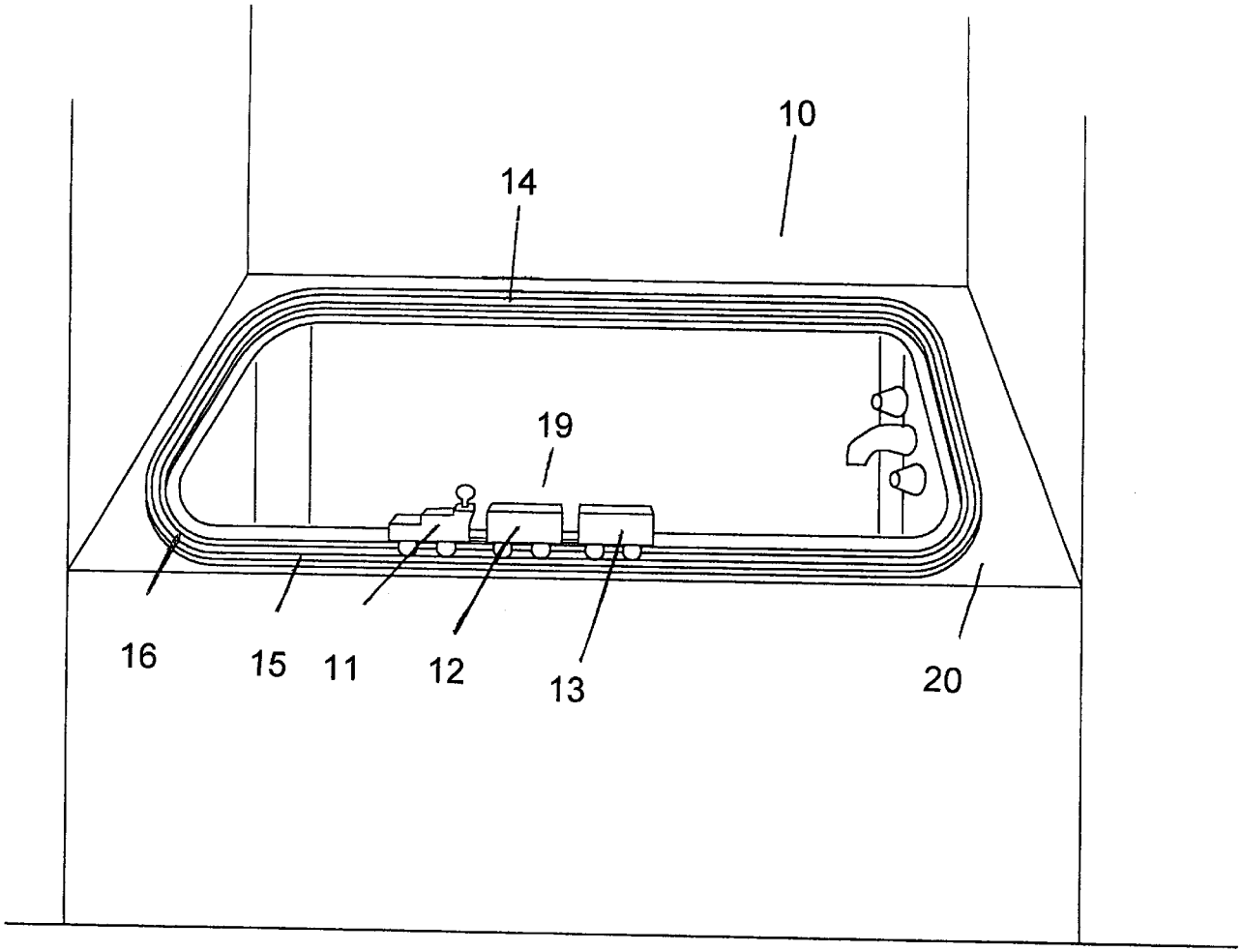
FIG. 1 is a perspective drawing of a toy railroad assembly including a toy train, which has a toy engine and two cars, and a toy railroad track which has a plurality of straight and curved track sections and which is securely coupled to a peripheral surface of a bathtub according to the first embodiment of the present invention.
Figures 2, 3, 4:
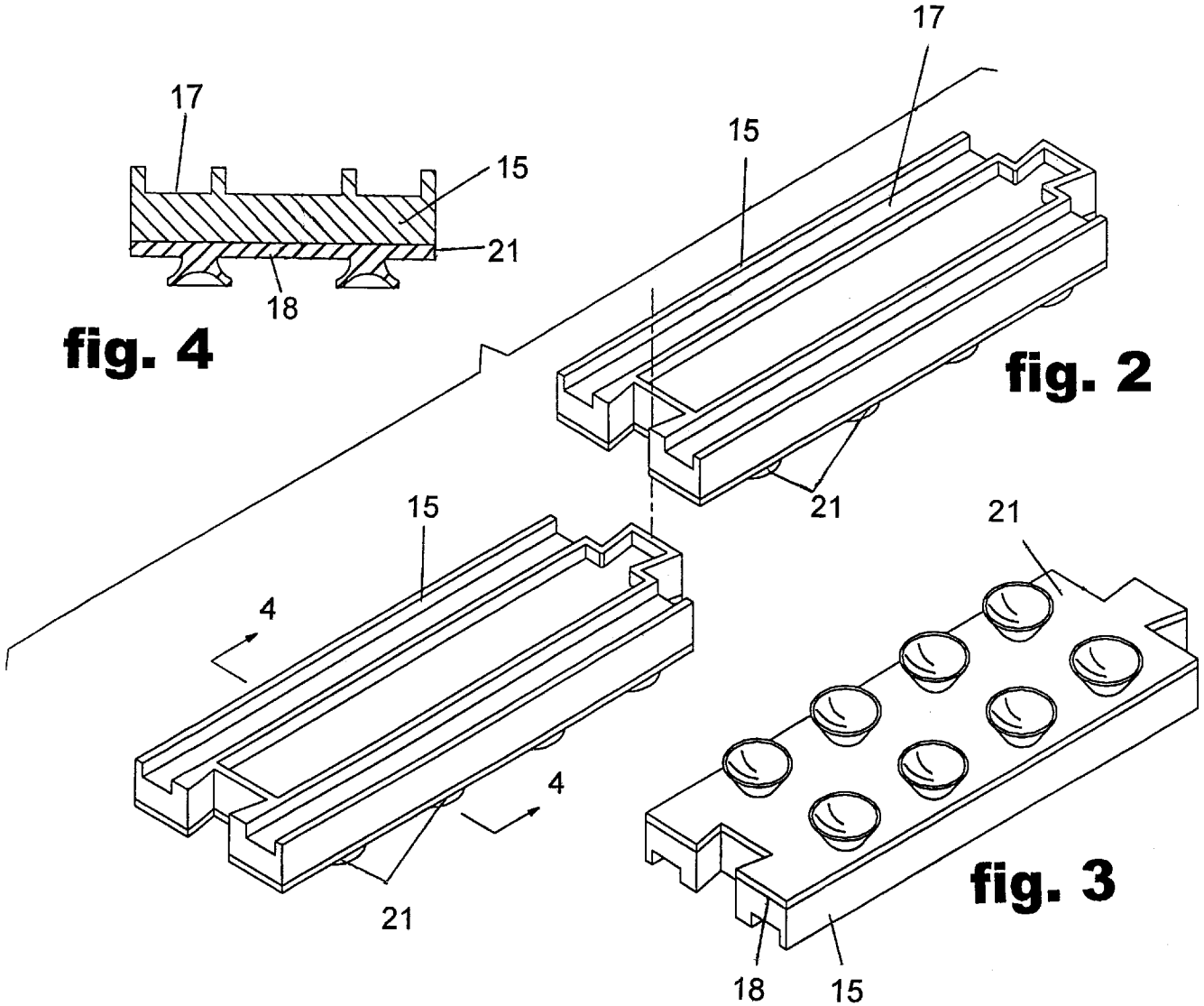
FIG. 2 is a perspective drawing of two track sections of the toy railroad track of FIG. 1 as they are about to be connected together.
FIG. 3 is a perspective drawing of one of the track sections of the toy railroad track of FIG. 1.
FIG. 4 is an cross-sectional view of one of the track sections of the toy railroad track of FIG. 1 taken along line 4—4 of FIG. 2.

Referring to FIG. 1 in conjunction with FIG. 2 a toy railroad assembly 10 includes a toy engine 11, a first car 12, a second car 13 and a toy track 14. The toy track includes a plurality of straight track sections 15 and a plurality of curved track sections 16. The straight and curved track sections 15 and 16, respectively, are coupled together to form the toy railroad track 14. Each of the straight and curved track sections 15 and 16, respectively, has a top surface 17 and a bottom surface 18. The toy engine 11 is coupled to the first and second cars 12 and 13 in order to form a toy train 19. The toy train 17 rides on the top surface 17 of the toy railroad track 14. The bottom surface of the toy railroad track 14 is disposed on a peripheral surface 20 of a bathtub.

Referring to FIG. 3 in conjunction with FIG. 1 and FIG. 4 each of the straight and curved track sections 15 and 16 has a layer 21 with a plurality of suction cups which are coupled to the bottom surface 18 thereof so that the toy railroad track may be securely coupled to the peripheral surface 20 of the bathtub.

Figure 5:
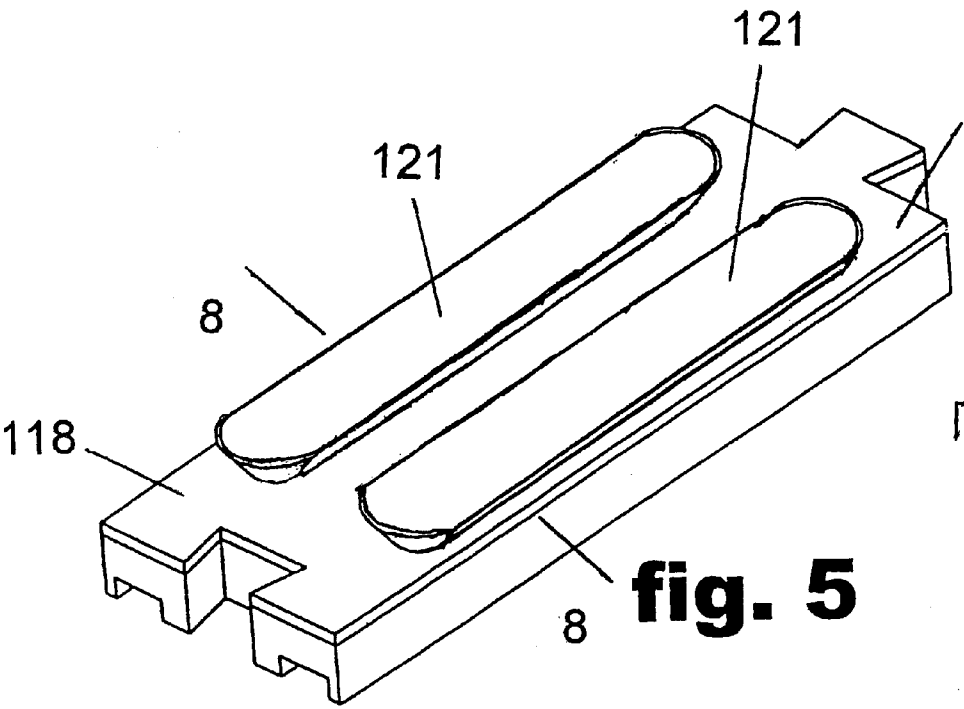
FIG. 5 is a perspective drawing of a track section of a toy railroad track according to the second embodiment of the present invention.

Referring to FIG. 5 in conjunction with FIG. 1 a TOMY trainset has accessories including buildings, bridges, switches and railroad signals. All of these accessories may be used in conjunction with the toy railroad track 14.

Figure 6:
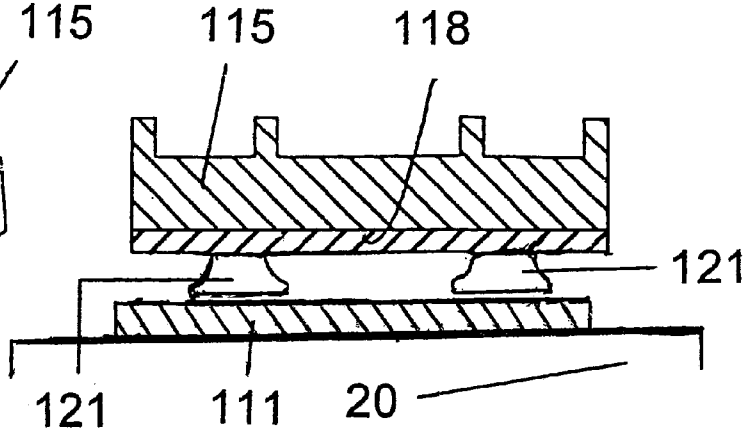
FIG. 6 is a cross-sectional view of one of the track sections of the toy railroad track of FIG. 1 taken along line 8–8 of FIG. 5.

Referring to FIG. 6 in conjunction with FIG. 1 a toy railroad assembly which U.S. Pat. No. 3,579,904 teaches also has accessories including buildings, bridges, switches and railroad signals. All of these accessories may be used in conjunction with the toy railroad track 14.

Figure 8:
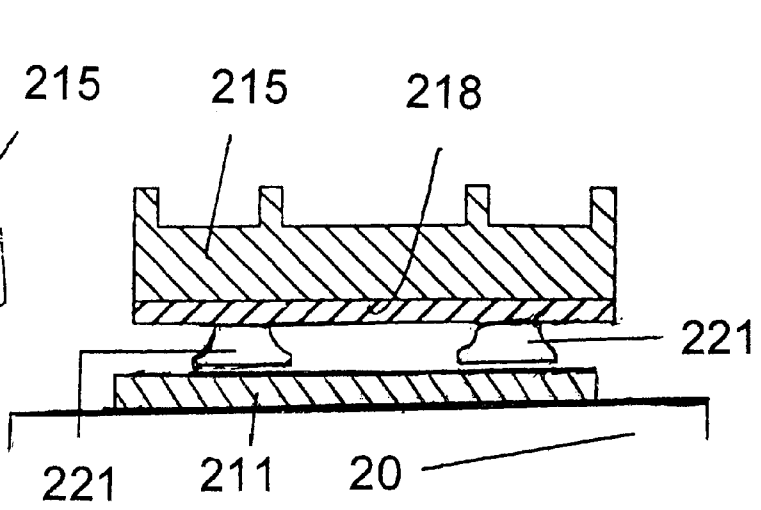
FIG. 8 is a cross-sectional view of one of the track sections of the toy railroad track of FIG. 1 taken along line 10—10 of FIG. 7.
Figure 7:
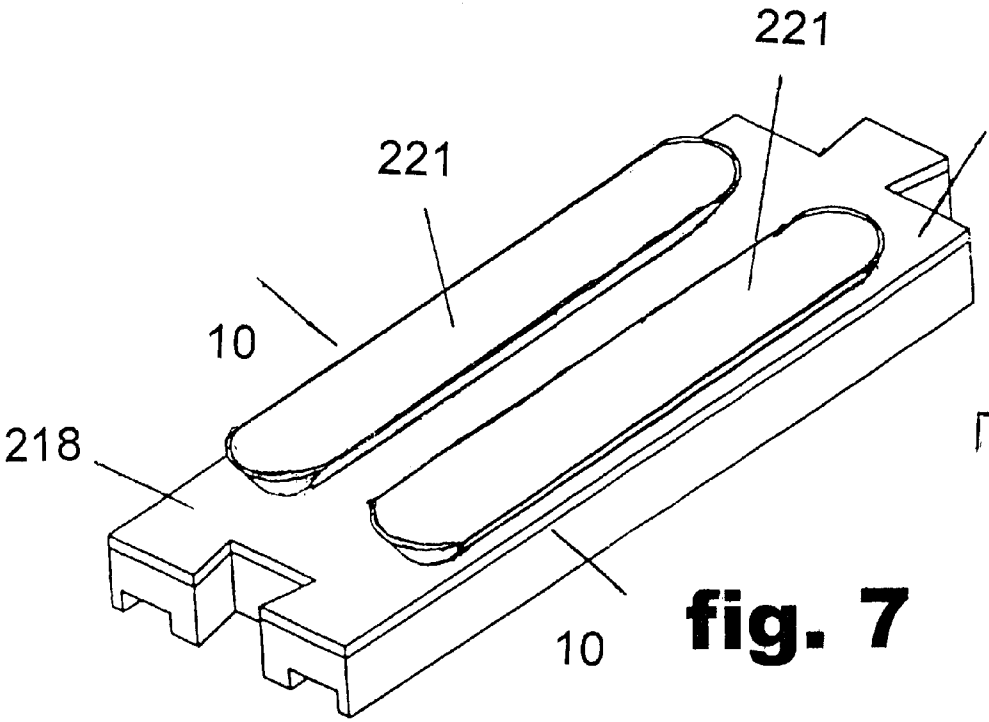
FIG. 7 is a perspective drawing a track sections of a toy track according to the third embodiment of the present invention.

Referring to FIG. 7 in conjunction with FIG. 1 and FIG. 8 the peripheral surface 20 of the bathtub has a layer 111 of magnetic material adhered thereto. Each track section 115 has a plurality of magnets 121 which are coupled to the bottom surface 118 thereof so that the toy railroad track may be securely coupled to the peripheral surface 20 of the bathtub.

Referring to FIG. 9 in conjunction with FIG. 1 and FIG. 10 the peripheral surface 20 of the bathtub has a layer 211 of male fasteners adhered thereto. Each track section 215 has a plurality of female fasteners 221 which are coupled to a bottom surface 218 thereof so that the toy railroad track may be securely coupled to the peripheral surface 20 of the bathtub.

From the foregoing it can be seen that a toy train and a toy railroad track which is securely coupled to the peripheral surface of a bathtub have been described. It should be noted that the sketches are not drawn to scale and that distance of and between the figures are not to be considered significant. Accordingly it is intended that the foregoing disclosure and showing made in the drawing shall be considered only as an illustration of the principle of the present invention.

What is claimed is:

1. For use with a toy train being formed by a toy engine and a plurality of cars, a toy railroad track, attached to a bathtub, comprising:

a. a plurality of straight and curved track sections each of which has a top surface and a bottom surface and which are configured to be coupled together to form said toy railroad track; and b. a plurality of straight and curved layers each of which has a shape corresponding one of said straight and curved track sections, respectively, and has a top surface and a bottom surface with said bottom surface having a plurality of suction cups disposed thereon and said top surface being coupled to said bottom surface of one of said straight and curved track sections, respectively, said suction cups securely coupled to a peripheral surface of the bathtub in order for the toy train to ride on said top surface of said toy railroad track.

2. For use with a toy train a toy railroad track according to claim 1 wherein each of said plurality of straight and curved track sections is made out of a plastic.

3. For use with a toy train being formed by a toy engine and a plurality of cars, a toy railroad track, attached to a bathtub, comprising:

a. a plurality of straight and curved track sections each of which has a top surface and a bottom surface and which are configured to be coupled together to form said toy railroad track;

b. a layer of magnetic material adhered to a peripheral surface of the bathtub in the shape of said toy railroad track; and c. a plurality of straight and curved layers each of which has a shape corresponding one of said straight and curved track sections, respectively, and has a top surface and a bottom surface with said bottom surface having a plurality of magnets and said top surface being coupled to said bottom surface of one of said straight and curved track sections, respectively, said magnets securely coupled to said layer of magnetic material in order for the toy train to ride on said top surface of said toy railroad track.

4. For use with a toy train being formed by a toy engine and a plurality of cars, a toy railroad track, attached to a bathtub, comprising:

a. a plurality of straight and curved track sections each of which has a top surface and a bottom surface and which are configured to be coupled together to form said toy railroad track;

b. a layer of first fastening component mounted to a peripheral surface of the bathtub in the shape of said toy railroad track; and c. a plurality of straight and curved layers each of which has a shape corresponding one of said straight and curved track sections, respectively, and has a top surface and a bottom surface with said bottom surface having a second fastening component and said top surface being coupled to said bottom surface of one of said straight and curved track sections, respectively, said track sections, respectively, said second fastening component securely coupled to said first fastening component in order for the toy train to ride on said top surface of said toy railroad track.

5. For use with a toy train a toy railroad track according to claim 1 wherein each of said plurality of straight and curved track sections is made out of rubber.

* * * * *